US005164023A

United States Patent [19]

Tabaru et al.

[11] Patent Number: 5,164,023

[45] Date of Patent: Nov. 17, 1992

[54] RARE EARTH PERMANENT MAGNET, METHOD OF HEAT TREATMENT OF SAME, AND MAGNET BODY

[75] Inventors: Kazunori Tabaru, Saitama; Michihisa Shimizu, Gyoda, both of Japan

[73] Assignee: Hitachi Metals Ltd., Tokyo, Japan

[21] Appl. No.: 703,652

[22] Filed: May 21, 1991

[30] Foreign Application Priority Data

Jun. 8, 1990 [JP] Japan ..... 2-150596

[51] Int. Cl.[5] ..... H01F 41/02

[52] U.S. Cl. ..... 148/101; 148/105; 419/29

[58] Field of Search ..... 148/101, 105; 419/29

[56] References Cited

U.S. PATENT DOCUMENTS

| | | | |
|---|---|---|---|
| 4,746,378 | 5/1988 | Wysiekierski et al. | 148/101 |
| 4,863,511 | 9/1989 | Ishii et al. | 148/101 |
| 4,875,946 | 10/1989 | Heh et al. | 148/103 |

FOREIGN PATENT DOCUMENTS

| | | |
|---|---|---|
| 0069362 | 1/1983 | European Pat. Off. . |
| 2142110 | 3/1972 | Fed. Rep. of Germany . |
| 48-364 | 1/1973 | Japan . |

OTHER PUBLICATIONS

Patent Abstracts of Japan, vol. 13, No. 293 (C-615)(3641) Jul. 6, 1989 & JP-1 087 715 Fuji Electrochem Co.) Mar. 31, 1989.

IEEE Transactions on Magnetics, vol. 7, No. 3, Sep. 1971, New York US pp. 429-431; J. Schweizer et al: Coercivity of Heat-Treated Pr-Co Powder Compacts'.

*Primary Examiner*—George Wyszomierski

*Attorney, Agent, or Firm*—Sughrue, Mion, Zinn, Macpeak & Seas

[57] ABSTRACT

There is disclosed a rare earth permanent magnet composed of a sintered product consisting of R and M where R represents at least one rare earth, and M represents Co or a combination of Co and at least one kind selected from the group consisting of Fe, Ni and Cu, the sintered product being of such a composition that a $RM_5$ phase and a $R_2M_7$ phase occur in the sintered product. The sintered product contains 63 to 65 wt. % of M, and the sintered product has a coercive force iHc of not less than 13,000 Oe. The permanent magnet can have a disk-shape, a ring-shape or a cylindrical shape. A method of heat treatment of the permanent magnet is also disclosed.

5 Claims, 1 Drawing Sheet

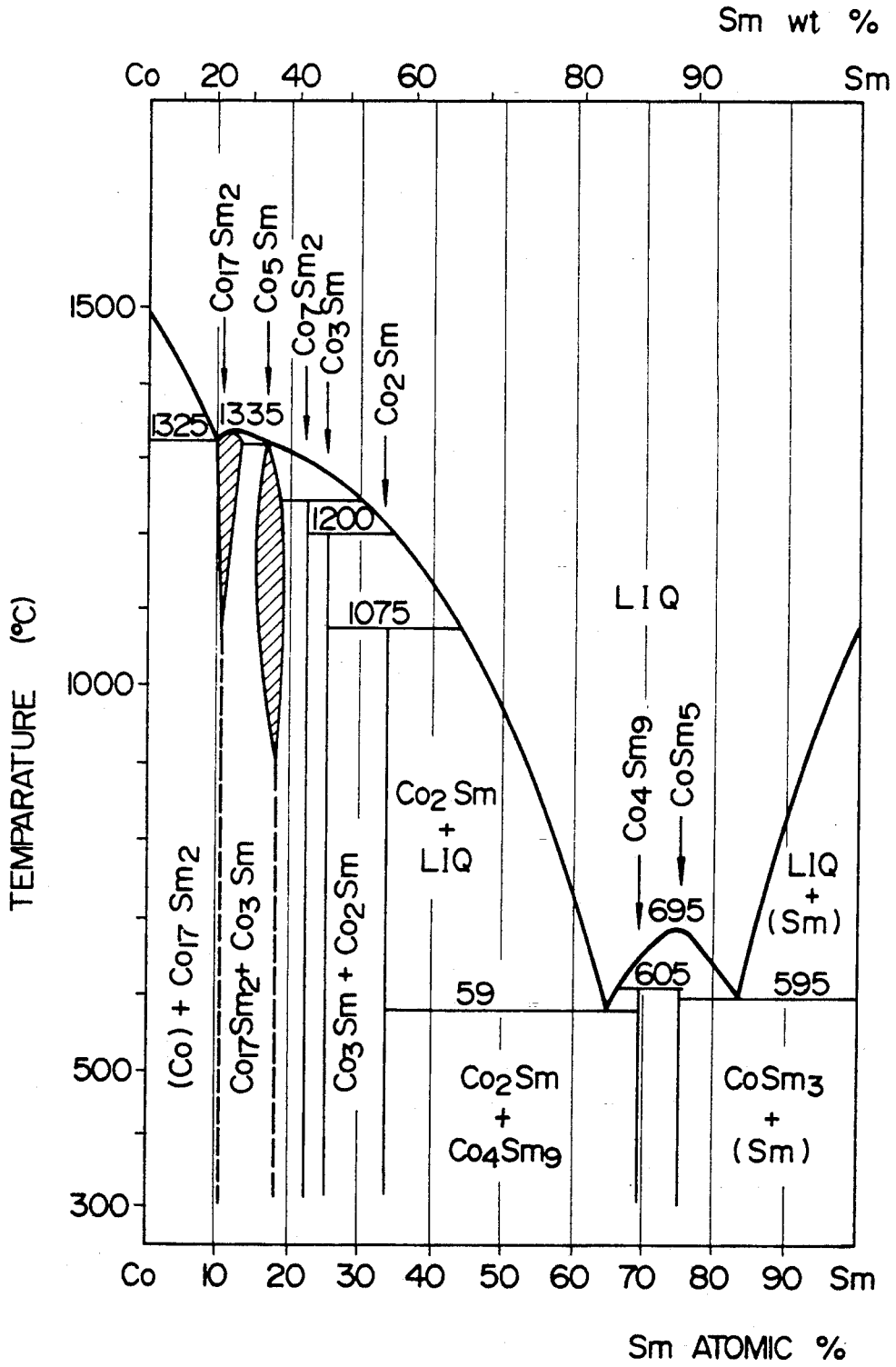
Sm wt %
Co 20 40 60 80 90 Sm
1500
1000
500
300
TEMPARATURE (°C)
Co17Sm2
Co5Sm
Co7Sm2
Co3Sm
Co2Sm
1325
1335
1200
1075
LIQ
Co4Sm9
CoSm5
Co2Sm + LIQ
(Co) + Co17Sm2
Co17Sm2 + Co3Sm
Co3Sm + Co2Sm
695
605
595
59
LIQ + (Sm)
Co2Sm + Co4Sm9
CoSm3 + (Sm)
Co 10 20 30 40 50 60 70 80 90 Sm
Sm ATOMIC %

RARE EARTH PERMANENT MAGNET, METHOD OF HEAT TREATMENT OF SAME, AND MAGNET BODY

BACKGROUND OF THE INVENTION

This invention relates to a $RM_5$-type (e.g., $SmCO_5$) rare earth permanent magnet, a method of heat treatment of the same, and a magnetic body having a specific outer shape, and more particularly to a rare earth permanent magnet of a large size required for a corpuscular ray accelerator and an image diagnostic device.

$SmCo_5$-type rare earth permanent magnets have heretofore been used as small size high-performance permanent magnets. For producing a $SmCo_5$-type permanent magnet, an alloy consisting of 65.75 to 66.0 wt. % Co and the balance Sm is first melted by high-frequency melting in an Ar atmosphere, and the molten alloy is cast into an ingot, and the ingot is pulverized in a protective atmosphere into fine powder by a ball mill or the like. The thus obtained powder whose particle size is several μm is compressed and compacted by a mold (which is disposed in a magnetic field) into a compact, and this compact is sintered at a temperature of not less than 1100° C. Then, the resultant sintered product is again maintained at 950° to 1000° C. for 1 to 2 hours in an Ar atmosphere, and then is cooled in a furnace at a rare of 0.1° to 3° C./min. After the sintered product is cooled to a temperature of 770° to 830° C., the sintered product is quenched in oil or in a sand-Ar fluid bed. Such a heat treatment method is disclosed in Solid Communications, 8 pp. 139 to 141 (1970). In the heat treatment, it is necessary that the sintered product should be cooled in the furnace to a low temperature between the sintering temperature and a temperature lower than the sintering temperature by about 300° C. (usually, the sintered product having been maintained for a predetermined period of time is cooled in a furnace to a low temperature lower than the sintering temperature by 500° C. or less), and then is quenched to a temperature not more than about 300° C. When the above quenching treatment is not applied to the $SmCo_5$-type rare earth permanent magnet, the coercive force iHc is greatly lowered due to so-called Westendorph effect (i.e., a phenomenon in which the coercive force iHc exhibits an extremely small value at a specific temperature) as clearly described in the above-mentioned technical report, and the resultant permanent magnet fails to have a high coercive force which is a feature of the $SmCo_5$-type permanent magnet, and therefore can not be suited for practical use. Therefore, in the heat treatment of $SmCo_5$-type magnets, the decrease of the coercive force iHc due to the Westendorph effect has been avoided by the quenching in oil, the quenching by the fluid bed or the quenching by gas-jetting (or a water-cooling quenching for a very small-size magnet), thereby providing the permanent magnet of a high coercive force. There is also known a $SmCo_5$-type rare earth permanent magnet of a higher performance which is composed of composite components. Such magnet consists, by weight, of a rare earth metal (23 to 30% Y, 32 to 40% Ce, 34 to 42% Sm, or 32 to 40% Pr) or 34 to 42% of a mixture (mesh metal) thereof, and the balance Co (see Japanese Patent Examined Publication No. 48-364).

Because of its high magnetic characteristics, the magnetic flux amount of the above $SmCo_5$-type anisotropic rare earth permanent magnet is large per unit volume of the permanent magnet. Therefore, this permanent magnet, when used in conventional audio parts, automotive electric parts, and computer and office automation parts, has been designed to have as small a size as possible. Recently, however, there has been an increasing demand for a large-size rare earth magnet for use in a part of a corpuscular ray accelerator, such as a wiggler, an undulator and a high vacuum pump, a drive source for a servo motor or the like, and an image diagnostic device.

Particularly, the $SmCo_5$-type permanent magnet has a high coercive force and a high Curie point of 710° C. and is excellent in heat resistance and corrosion resistance, and therefore there has been a demand for a large-size, integral $SmCo_5$-type permanent magnet in the fields of the automotive and aircraft electric parts and the accelerator-related part which particularly require an excellent thermal stability.

When quenching such a large-size permanent magnet, there is encountered a problem that cracks develop in the permanent magnet. For example, with respect to the permanent magnet for a wiggler, even a small-size magnet weighs 200 to 500 g per block, and a large-size magnet weighs more than 2 kg per block. In the quenching of such a large-size permanent magnet, in addition to the frequent development of cracks and fracture, the cooling effect does not proceeds into the interior of the magnet because of its large volume, and besides desired magnetic characteristics can not be obtained. To prevent such cracking and fracture, it has been proposed to employ a heat treatment of a recuperative oil-cooling system used for the quenching and tempering of steel; however, with this heat treatment, desired magnetic characteristics can not still be obtained. The reason for this will be mentioned. The $SmCo_5$-type permanent magnet has a thermal expansion coefficient of $6.6\times10^{-6}$/°C. in the direction of the C-axis of the crystal grain (which constitutes the permanent magnet) and a thermal expansion coefficient of $12.6\times10^{-6}$/°C. in the direction perpendicular to the C-axis. Therefore, when a large temperature difference occurs between the interior and surface of the permanent magnet at the time of the quenching, a tensile stress is induced on the surface of the magnet which cools faster.

For the above reason, the large-size anisotropic rare earth permanent magnet must be assembled by bonding a plurality of block-like permanent magnets together by an adhesive. However, the adhesive exists in the boundary between the adjacent permanent magnets to form magnetic gaps, and the magnetic flux density is greatly decreased at these magnetic gaps, which results in a problem that the uniformity of the overall magnetic characteristics is adversely affected, thus adversely affecting the overall performance of the device. Further, the above-mentioned wiggler is used under high vacuum and in an environment in which radiation including ultraviolent rays is present. Therefore, there is also encountered a problem that the adhesive performance is deteriorated due to the evaporation of the adhesive under high vacuum and the application of the radiation to the adhesive. A further problem is that the above assembling by the bonding using the adhesive is an extremely complicated operation, and therefore requires much time and labor, and also makes it difficult to provide the product of a uniform quality.

SUMMARY OF THE INVENTION

With the above deficiencies of the prior art in view, it is an object of this invention to provide a rare earth permanent magnet of a large size and an integral construction without the use of an additional material such as an adhesive.

Another object of the invention is to provide a method of heat treatment of such a rare earth permanent magnet.

A further object of the invention is to provide a magnet body made of such a rare earth permanent magnet.

According to a first aspect of the present invention, there is provided a method of heat-treating a rare earth permanent magnet composed of a sintered product consisting of R and M where R represents at least one rare earth element, and M represents Co or a combination of Co and at least one kind selected from the group consisting of Fe, Ni and Cu, the sintered product being of such a composition that a $RM_5$ phase and a $R_2M_7$ phase occur in the sintered product, the method comprising the steps of:

maintaining the sintered product in a temperature region T1 for not less than 10 minutes, the sintered product containing 63 to 65 wt. % of M, and the temperature region T1 being not more than a sintering temperature, and the difference between the temperature region T1 and the sintering temperature being within 300° C.;

subsequently cooling the sintered product at a rate of 0.03° to 3° C./min. in a furnace; and subsequently maintaining the sintered product for not less than one hour at a low temperature region T2 which is lower than the temperature region T1, the difference between the low temperature region T2 and the sintering temperature being within 500° C.

According to a second aspect of the invention, the sintered product in the first aspect of the invention is gradually cooled from the low temperature region T2 to a temperature of not more than 400° C. at a rate of 5° to 50° C./min.

According to a third aspect of the invention, there is provided a rare earth permanent magnet composed of a sintered product consisting of R and M where R represents at least one rare earth element, and M represents Co or a combination of Co and at least one kind selected from the group consisting of Fe, Ni and Cu, the sintered product being of such a composition that a $RM_5$ phase and a $R_2M_7$ phase occur in the sintered product, the sintered product containing 63 to 65 wt. % of M, and the sintered product having a coercive force iHc of not less than 13,000 Oe.

In the third aspect of the invention, the permanent magnet can be composed of a single body having a weight of not less than 200 g.

According to a fourth aspect of the invention, the permanent magnet in the third aspect of the invention has a body whose outer shape is one of a disk-shape, a ring-shape and a cylindrical shape.

In the first to third aspects of the invention, if the content of M is less than 63 wt. %, the residual flux density Br, the coercive force bHc and the maximum energy product (BH)max are lowered, and this is undesirable. If the content of M exceeds 65 wt. %, the coercive forces bHc and iHc, the maximum energy product (BH)max and the sintered density are lowered, and this is undesirable.

In the first and second aspects of the invention, if the maintaining temperature (the temperature region T1) exceeds the sintering temperature, the grain growth is invited, so that the coercive force iHc is lowered, which is undesirable. If this maintaining temperature is so low that the difference between this maintaining temperature and the sintering temperature is more than 300° C., it is very difficult to control the precipitation of the $R_2M_7$ phase, so that the coercive force bHc and the maximum energy product (BH)max are lowered, which is undesirable. If the maintaining temperature (the low temperature region T2) after the cooling in the furnace is so low that the difference between this maintaining temperature and the sintering temperature is more than 500° C., the residual flux density Br and the coercive force iHc are lowered, which is undesirable. With respect to the above temperature regions, the relation ($T2 \leqq T1$) must be provided in order to restrain the grain growth of the $RM_5$ phase (which is the main phase for the single magnetic domain grain size) and also to sufficiently effect a delayed precipitation of the $R_2M_7$ phase.

Next, the rate or speed of the cooling in the furnace as well as the rate of the gradual cooling will now be described. First, if the rate of the cooling in the furnace is more than 3° C./min., the amount of precipitation of the $R_2M_7$ phase which restrains the grain growth of the $RM_5$ phase (the main phase) is small, and this is undesirable since the coercive forces bHc and iHc are lowered. The reason for the lowering of the coercive force is thought to be as follows. In the heat treatment method of the present invention, in order that the $R_2M_7$ phase can be precipitated from the solid solution phase (of which representative example is the $SmCo_5$ phase as shown in the figure) at the sintering temperature to provide the composite structure, it is necessary that the composition of the rare earth permanent magnet be the composition of the region close to the boundary of the R side defining the single solid phase region of the $RM_5$ intermetallic compound. The influence of the Westendorph effect on this region is reduced by the above heat treatment, thereby enhancing the coercive force iHc. That the Westendorph effect is small means that the reaction speed for the precipitation of the $R_2M_7$ phase is slow. Therefore, if the rate or speed of the cooling in the furnace is larger than 3° C./min., the coercive force iHc sufficiently high for practical use can not be obtained, and this is undesirable. On the other hand, even if the above cooling rate is less than 0.03° C./min., the coercive force iHc can be enhanced; however, from an industrial point of view, that is, from the viewpoint of the operation rate, it is not desirable to spend too much time on the heat treatment. Therefore, it is preferred that the lower limit of this cooling rate should be 0.03° C./min. If the rate of the gradual cooling is more than 50° C./min., cracking, fracture and the like develop, and this is undesirable. On the other hand, if this cooling rate is less than 5° C./min., the so-called Westendorph effect appears to lower the coercive force, and this is undesirable.

As described above, in the present invention, the content of M is 63 to 65 wt. % which is smaller than that of the conventional permanent magnet, and by doing so, the Westendorph effect can be reduced, and the need for the quenching treatment can be obviated, and with the heat treatment at the temperature region T1 and the heat treatment (after the cooling in the furnace) at the low temperature region T2, there can be obtained the rare earth permanent magnet which is free from cracking and fracture and hence is sound and has excellent magnetic characteristics.

In order to prevent the cracking, it is advantageous that the outer shape of the magnet body in the fourth aspect of the invention should be a disk-shape, a ring-shape or a cylindrical shape (in which only two sides thereof intersect) rather than a plate-shape or a rectangular parallelepipedic shape which has apexes at which three sides thereof intersect. The reason is that cracks are most liable to develop in the vicinity of the apex of a cube where the cooling rate or speed is the maximum.

BRIEF DESCRIPTION OF THE DRAWING

The figure is a constitutional diagram of Sm-Co alloys.

DESCRIPTION OF THE INVENTION

EXAMPLE 1

$SmCo_5$ permanent magnet alloys, composed of Co (whose amount is shown in Table 1) and the balance Sm, were prepared by arc melting, and each of the alloys was cast into an ingot. Each ingot thus obtained was roughly pulverized into 35 mesh by a stamp mill, and then was pulverized into fine powder for 3 hours by a ball mill. Then, this powder was filled in a mold having a mold cavity of a transverse cross-section (30 mm×30 mm), and a parallel magnetic field of 8000 Oe was applied in a horizontal direction to the powder filled in the mold cavity, and in this condition, the powder was compacted. Then, according to the amount of Co, the thus obtained compacts were sintered at a temperature of 1170° to 1210° C., and then maintained (heat treated) at a temperature of 890° to 1190° C., and then maintained (heat treated) at a temperature of 700° to 810° C., thereby producing sintered products (30 mm×29.5 mm×126 mm) having a weight of about 1 kg. A sample (10 mm×8 mm×7 mm) was taken from each of the sintered products thus obtained, and after the sample was magnetized, its magnetic characteristics and sintered density were measured. Results thereof are also shown in Table 1. The magnetic field on the sintered product was oriented in the direction of its dimension of 29.5 mm, and the magnetic field on the sample was oriented in the direction of its dimension of 7 mm. Incidentally, with respect to a permanent magnet for a wiggler and an undulator, preferred requirements are Br>8400 G, bHc≧8000 Oe and iHc≧13000 Oe, and more preferred requirements are Br≧8600 G, bHc≧8200 Oe and iHc≧15000 Oe.

TABLE 1

| No. | Co amount (wt. %) | Br (G) | bHc (Oe) | iHc (Oe) | (BH)max (MGOe) | sintered density (g/cm³) |
|---|---|---|---|---|---|---|
| 1 | 62.50 | 7970 | 7890 | 23300 | 16.0 | 8.6 |
| 2 | 62.75 | 8330 | 8260 | 19700 | 17.6 | 8.5 |
| 3 | 63.00 | 8540 | 8390 | 18300 | 18.3 | 8.5 |
| 4 | 63.25 | 8600 | 8250 | 18800 | 17.8 | 8.5 |
| 5 | 63.50 | 8690 | 8640 | 19300 | 19.0 | 8.5 |
| 6 | 63.75 | 8720 | 8400 | 21600 | 18.7 | 8.5 |
| 7 | 64.00 | 8990 | 8640 | 20000 | 20.0 | 8.6 |
| 8 | 64.25 | 9020 | 8650 | 19600 | 20.4 | 8.5 |
| 9 | 64.50 | 9140 | 8710 | 18000 | 20.7 | 8.5 |
| 10 | 64.75 | 9300 | 8800 | 16900 | 20.9 | 8.5 |
| 11 | 65.00 | 9320 | 8800 | 15100 | 21.0 | 8.5 |
| 12 | 65.25 | 9320 | 8730 | 14500 | 20.3 | 8.4 |
| 13 | 65.50 | 9330 | 8330 | 10800 | 19.4 | 8.4 |
| 14 | 65.80 | 9330 | 2020 | 3800 | 8.7 | 8.4 |

As is clear from Table 1, with respect to Sample Nos. 1 and 2, although the value of iHc is large, the values of Br and bHc are small, and therefore the value of (BH)max is also small. On the other hand, with respect to Sample Nos. 12 to 14, the sintered density is low, and the value of iHc is small, although the value of Br is large. In contrast, each of Sample Nos. 3 to 11 exhibits excellent magnetic characteristics, and it will be appreciated that more preferable magnetic characteristics can be obtained with the Co content of 63 to 65 wt. %.

EXAMPLE 2

According to the same procedure as in Example 1, permanent magnet alloys composed of Co (whose amount was 63.50 wt. %, 64.25 wt. % or 64.50 wt. %) and the balance Sm were prepared, and each alloy was cast into an ingot, and a sintered product (126 mm×53 mm×30 mm (the direction of orientation of the magnetic field)) having a weight of about 2 kg was obtained from each ingot. The sintered products thus obtained were subjected to heat treatments, with the maintaining temperature T1 after the re-heating, the cooling rate Vt for the cooling in a furnace, and the maintaining temperature T2 after the cooling in the furnace being varied. Then, as in Example 1, each sintered product was allowed to be gradually cooled in an atmosphere of argon. Part of results of measurement of magnetic characteristics are shown in Table 2. In view of the fact that the permanent magnets were of a large size, the maintaining time for T1 and the maintaining time for T2 were 2 hours and 15 hours, respectively, so that the temperature of each magnet could be uniform from its surface to its interior.

TABLE 2

| No. | Co (wt. %) | Sintering temp. (°C.) | Tl (°C.) | Vt (°C./min.) | T2 (°C.) | Br (G) | bHc (Oe) | iHc (Oe) | (BH)max (MGOe) |
|---|---|---|---|---|---|---|---|---|---|
| 1 | 64.50 | 1190 | 1190 | 0.5 | 810 | 8570 | 8360 | 26200 | 18.4 |
| 2 | 64.50 | 1200 | 900 | 0.5 | 700 | 8520 | 8270 | 26100 | 18.4 |
| (3) | 64.50 | 1200 | 890 | 0.5 | 790 | 8450 | 7070 | 24800 | 17.7 |
| 4 | 64.50 | 1200 | 1000 | 1.0 | 850 | 9200 | 9230 | 17500 | 21.4 |
| 5 | 64.25 | 1205 | 1150 | 1.5 | 770 | 8700 | 8700 | 22900 | 19.2 |
| (6) | 64.25 | 1205 | 1150 | 1.5 | 690 | 8340 | 8190 | 14060 | 17.1 |
| (7) | 64.25 | 1205 | 1150 | 4.0 | 770 | 8170 | 7600 | 20400 | 16.8 |
| 8 | 63.50 | 1205 | 980 | 0.03 | 790 | 8680 | 8620 | 21000 | 19.1 |
| 9 | 63.50 | 1205 | 1000 | 2.0 | 800 | 8610 | 8320 | 20200 | 18.0 |
| 10 | 63.50 | 1205 | 980 | 3.0 | 810 | 8510 | 8270 | 20500 | 18.1 |

Note:
() in the column "No." represents comparative example.

In Table 2, with respect to Sample No. 3, the coercive force bHc is much lowered. As is clear from the constitutional diagram of the figure, the reason for this is that T1 is 410° C. lower than the sintering temperature and therefore is lower than the lower limit of the uniform solid solution region causing the precipitation of the $Sm_2Co_7$ phase, so that the precipitation of the $Sm_2Co_7$ phase serving to increase the coercive force is not sufficient. With respect to Sample No. 6, the coercive force iHc is much lowered. The reason for this is that since T2 is 515° C. lower than the sintering temperature, the Westendorph effect, though gently, develops. With respect to Sample No. 7, since the cooling rate for the cooling in the furnace is as high as 4° C./min., the precipitation of the $Sm_2Co_7$ phase during the cooling in the furnace can not proceed sufficiently, so that both Br and bHc are lowered. On the other hand, with respect to Sample Nos. 1, 2, 4, 5 and 8 to 10, the values of Br, bHc and iHc are high, and therefore the heat treatment conditions for these Samples are sufficient to cause an appropriate amount of the $Sm_2Co_7$ phase to be precipitated.

EXAMPLE 3

With respect to sintered products whose Co content was 64.25 wt. %, magnetic characteristics were measured with the maintaining time being varied after the cooling in the furnace, and results thereof are shown in Table 3. In this case, the sintering temperature was 1205° C., and the maintaining temperature T1 after the re-heating was 1000° C., and the cooling rate Vt for the cooling in the furnace was 1.0° C./min., and the maintaining temperature T2 after the cooling in the furnace was 800° C., and samples were prepared on the same conditions as described above. Also, a comparative sample of a conventional composition (Co content: 65.95 wt. %) was prepared.

TABLE 3

| No. | Maintaining time (hr) | Br (G) | bHc (Oe) | iHc (Oe) | (BH)max (MGOe) |
|---|---|---|---|---|---|
| 1 | 0.02 | 8440 | 6230 | 10500 | 13.1 |
| 2 | 0.16 | 8450 | 7420 | 11700 | 15.7 |
| 3 | 0.5 | 8460 | 8020 | 14080 | 17.0 |
| 4 | 1.0 | 8590 | 8380 | 15100 | 18.0 |
| 5 | 4.0 | 8680 | 8470 | 17500 | 18.4 |
| 6 | 12 | 8700 | 8490 | 18200 | 18.5 |
| 7 | 24 | 8700 | 8700 | 22900 | 19.2 |
| 8 | 48 | 8690 | 8730 | 23500 | 19.0 |
| 9 | 24 | 9440 | 4750 | 6440 | 15.1 |

As is clear from Table 3, by setting the maintaining temperature T2 after the cooling in the furnace to be 800° C., and as its maintaining time was increased, the magnetic characteristics were enhanced. However, with respect to Sample Nos. 1 and 2, the value of the magnetic characteristics is slightly low since the maintaining time is short. In order to obtain the permanent magnet of the above specification or design, it is preferred that the maintaining time be not less than one hour. On the other hand, Sample No. 9 (comparative example) exhibits much low values except that the value of Br is high. The above tendency also occurs with respect to the permanent magnets of other compositions.

EXAMPLE 4

37 wt. % metal CeMM (Mesh metal), 62 wt. % Co and 1 wt. % of one of Fe, Ni and Cu were weighed and blended, and a CeMM-Co-Fe permanent magnet alloy, a CeMM-Co-Ni permanent magnet alloy and a CeMM-Co-Cu permanent magnet alloy were produced by melting in a high-frequency melting furnace in an Ar protective atmosphere. Each of these permanent magnet alloys was cast into an ingot. According to the same procedure as in the above Examples, each ingot was pulverized into fine powder, and the fine powder was filled in a disk-shaped cavity of a mold and a ring-shaped cavity of a mold, and a pressure of 1.2 t/cm$^2$ was applied to the filled powder in a direction parallel to a magnetic field of 10 kOe applied to the filled powder. In this manner, disk-shaped compacts (about 330 g/piece) and ring-shaped compacts (about 280 g/piece) were obtained. Then, according to their composition, the compacts were sintered at 1100° to 1200° C. in an Ar atmosphere to thereby produce disk-shaped sintered products (diameter: 50 mm; thickness: 20 mm) and ring-shaped sintered products (outer diameter: 50 mm; inner diameter: 20 mm; thickness: 20 mm). On the same conditions as in the above Examples, these disk-shaped magnets and the ring-shaped magnets were subjected to a heat treatment including the step in which each magnet was left to stand in an Ar atmosphere for cooling. Results of measurement of magnetic characteristics are shown in Table 4.

TABLE 4

| Item | Composition | Br (G) | bHc (Oe) | iHc (Oe) | (BH)max (MGOe) |
|---|---|---|---|---|---|
| Examples of the Invention | CeMM—Co—Fe | 6300 | 4220 | 6700 | 6.6 |
| | CeMM—Co—Ni | 6200 | 4160 | 6680 | 6.4 |
| | CeMM—Co—Cu | 6000 | 4300 | 6800 | 6.5 |
| Comparative Examples | CeMM—Co—Fe | 6300 | 950 | 1080 | 1.5 |
| | CeMM—Co—Ni | 6180 | 920 | 1060 | 1.4 |
| | CeMM—Co—Cu | 6000 | 940 | 1100 | 1.4 |

As is clear from Table 4, the values of these magnetic characteristics are very much lower than those shown in Table 1 described above. The reason for this is that the CeMM alloy (whose main component was inexpensive Ce) composed of several kinds of rare earths was used instead of Sm, since the rare earth, though improving the magnetic characteristics, is expensive. By forming the permanent magnet into the disk-shape, the ring-shape (as described above) or a cylindrical shape having a relatively large thickness (20 mm), the permeance factor as well as the overall flux amount can be increased. In the compacting method in this Example, the pressure is applied in the direction parallel to the direction of the external magnetic field, and therefore the value of Br is about 10% lower as compared with the above-mentioned Examples in which the compacting pressure is applied in the direction perpendicular to the direction of the external magnetic field. The permanent magnets thus obtained were subjected to surface grinding, and then it was confirmed by visual inspection that any crack or fracture developed in the permanent magnets. On the other hand, when a conventional heat treatment including a quenching treatment was applied to the above sintered products, cracks developed in all of these sintered products. Also, as comparative examples, permanent magnets of conventional composition (metal CeMM: 33 wt. %; Co: 66 wt. %) were prepared, and the same heat treatment as in the above Example was applied to these comparative samples. The results thereof are also shown in Table 4. As is clear from Table 4, the samples of this Example (the invention) are far superior in magnetic characteristics to the comparative samples.

EXAMPLE 5

Permanent magnet alloys composed of 63 to 65 wt. % Co and the balance Sm were treated in the same manner as in Example 1 to produce sintered products (120 mm × 60 mm × 12 mm). Then, so-called radially-bipolar cylindrical magnets (10 in outer dia. × 5 in inner dia. × 12 mm) were formed from the sintered products by supersonic stamping. The weight of each cylindrical magnet was about 5 g.

In the same manner as in Example 1, each of the cylindrical magnets thus obtained was maintained for 1 hour at a low temperature (950° to 1100° C.) lower by not more than about 300° C. than the sintering temperature, and then was cooled in the furnace at a rate of 0.1° to 2° C./min., and was maintained for not less than 4 hours at a low temperature (690° to 870° C.) lower by not more than 500° C. than the sintering temperature, and then was quenched in oil. Thereafter, test pieces were cut off, and magnetic characteristics thereof were measured. Results thereof are shown in Table 5.

TABLE 5

| Composition (Co wt. %) | Magnetic characteristics Br (G) | bHc (Oe) | iHc (Oe) | (BH)max (MGOe) | Sintered density ( g/cm³) |
|---|---|---|---|---|---|
| 63.00 | 8570 | 8400 | 17900 | 18.0 | 8.5 |
| 63.25 | 8610 | 8420 | 18500 | 18.1 | 8.5 |
| 63.50 | 8680 | 8640 | 18900 | 18.7 | 8.5 |
| 63.75 | 8700 | 8650 | 20600 | 18.8 | 8.5 |
| 64.00 | 9010 | 8670 | 19800 | 19.5 | 8.5 |
| 64.25 | 9030 | 8690 | 19700 | 19.6 | 8.5 |
| 64.50 | 9150 | 8710 | 18500 | 19.9 | 8.5 |
| 64.75 | 9310 | 8830 | 17600 | 20.6 | 8.5 |
| 65.00 | 9330 | 8840 | 17000 | 20.6 | 8.5 |

As is clear from Table 5, in the case where the rare earth permanent magnets of the present invention are of a small size, high magnetic characteristics can be also obtained by maintaining the magnet for over the predetermined time period at the low temperature lower by not more than 500° C. than the sintering temperature and then by quenching the magnet. However, when the cylindrical magnets obtained in this Example were subjected to a conventional heat treatment including a quenching, the value of Br was a low level of 7400 to 7800 G.

In the above Examples, although the rare earth permanent magnets are designed to be used in a wiggler and an undulator, the present invention is not limited to such design, and the rare earth permanent magnets of the present invention can, of course, be applied to any other suitable device such as a rotating machine. Further, the present invention can be applied not only to the anisotropic permanent magnet but also to an isotropic permanent magnet.

With the above-mentioned construction and effects of the present invention, the following advantages can be achieved:

(1) Even if the permanent magnet is of a large size, any crack due to the heat treatment will not occur, and therefore there can be obtained the rare earth permanent magnet extremely excellent in magnetic characteristics.

(2) There is no need to bond block-like permanent magnets of a small size together by an additional material such as an adhesive, and therefore the manufacture is easy, and variations in quality can be greatly reduced.

(3) The quenching treatment for improving the magnetic characteristics is not needed, and therefore the heat treatment operation is easy and safe, and besides the environment of the operation can be kept clean.

What is claimed is:

1. A method of heat-treating a rare earth permanent magnet composed of a sintered product consisting of R and M where R represents at least one rare earth element, and M represents Co or a combination of Co and at least one element selected from the group consisting of Fe, Ni and Cu, said sintered product containing 63 to 65 wt. % of M and consisting essentially of a $RM_5$ phase and a $R_2M_7$ phase, said method comprising the steps of:

maintaining said sintered product at a temperature region T1 for not less than 10 minutes, and said temperature region T1 being not more than a sintering temperature, and the difference between said temperature region T1 and the sintering temperature being within 300° C.;

subsequently cooling said sintered product at a rate of 0.03° to 3° C./min. in a furnace; and subsequently maintaining said sintered product for not less than one hour at a low temperature region T2 which is lower than said temperature region T1, the difference between said low temperature region T2 and the sintering temperature being within 500° C. so as to produce a heat-treated rare earth permanent magnet having a maximum energy product of at least 17.8 MGOe.

2. A method according to claim 1, further including the step of gradually cooling said sintered product from said low temperature region T2 to a temperature of not more than 400° C. at a rate of 5° to 50° C./min.

3. A method according to calm 1, wherein said heat-treated rare earth permanent magnet has a coercive force iHc of not less than 13,000 Oe.

4. A method according to claim 1, wherein said heat-treated rare earth permanent magnet is composed of a single body having a weight of not less than 200 g.

5. A method according to claim 1, wherein said heat-treated rare earth permanent magnet has an outer shape selected from the group consisting of a disk, a ring and a cylinder.

* * * * *